US005625910A

United States Patent [19]

Erickson et al.

[11] Patent Number: 5,625,910

[45] Date of Patent: May 6, 1997

[54] PROTECTIVE SHIELD

[75] Inventors: Nate Erickson, Lewiston; Alan B. Eke, Blaine, both of Minn.; Joel W. Wolfe, New Richmond, Wis.; Adrian P. Sween, 205 Maryknoll Dr., Stillwater, Minn. 55083

[73] Assignee: Adrian P. Sween, Stillwater, Minn.

[21] Appl. No.: 459,363

[22] Filed: Jun. 2, 1995

[51] Int. Cl.[6] ..... E03C 1/181

[52] U.S. Cl. ..... 4/658; 4/300.3

[58] Field of Search ..... 4/658, 580, 300.3

[56] References Cited

U.S. PATENT DOCUMENTS

| | | |
|---|---|---|
| 222,846 | 12/1879 | Stevens . |
| 562,459 | 6/1896 | Davis . |
| 622,596 | 4/1899 | Boehringer . |
| 685,341 | 10/1901 | McHale . |
| 998,149 | 7/1911 | Barrett . |
| 1,221,137 | 4/1917 | Carney . |
| 1,225,256 | 5/1917 | Lambrix . |
| 1,302,658 | 5/1919 | Henning . |
| 1,355,086 | 10/1920 | Beebe . |
| 1,408,812 | 3/1922 | Leighton . |
| 1,579,374 | 4/1926 | Leighton . |
| 1,618,032 | 2/1927 | Wilkes . |
| 1,709,545 | 3/1929 | Sheppard . |
| 2,131,111 | 9/1938 | Marsh . |
| 2,508,808 | 5/1950 | Warman . |
| 2,510,238 | 6/1950 | Mau . |
| 2,970,321 | 2/1961 | Rovell et al. . |
| 4,722,103 | 2/1988 | Kliebert . |
| 4,969,220 | 11/1990 | Raigneau . |
| 5,012,537 | 5/1991 | Underwood . |

FOREIGN PATENT DOCUMENTS

| | | | |
|---|---|---|---|
| 1131325 | 2/1957 | France | 4/658 |
| 0594166 | 11/1947 | United Kingdom | 4/658 |

*Primary Examiner*—Charles E. Phillips

*Attorney, Agent, or Firm*—Merchant, Gould, Smith, Edell, Welter & Schmidt

[57] ABSTRACT

An apparatus for use in cooperation with a basin, such as a basin of a hopper sink, that protects an operator from splashing fluids and particulates. The apparatus includes a protective shield, structure for mounting the shield to the basin, and structure for attaching the shield to the basin mounting structure. The attaching structure includes a resilient material which serves to bias the shield outwardly toward the operator, when pressed inward by the operator, allowing the operator to work in the basin with minimal constraints.

14 Claims, 4 Drawing Sheets

PROTECTIVE SHIELD

FIELD OF THE INVENTION

This invention relates to a protective device for a hopper sink, and in particular a shield, which mounts on a hopper sink, for preventing splashing of potentially infectious pathogenic fluids and particulates (which may be staining or non-staining) from the basin of the hopper sink. The shield is configured to allow the operator to easily work within the basin and operate the faucets, etc. without constraining their movement.

BACKGROUND

Hopper sinks are found typically in nursing homes, hospitals, critical care facilities, laboratories and the like. Typically, blood, urine, feces, chemicals or other bodily fluids and tissues are disposed of through these sinks. These hopper sinks include components similar to conventional sinks, such as a faucet, basin, and spigot. However, the basins are usually larger and deeper, and the drain opening is larger in diameter, to accommodate solid waste products, tissue and the like. These hopper sinks are directly connected to a sewer or other waste line, similar to a toilet or the like.

Normally, operators cleaning or emptying various devices (e.g. bedpans, surgical appliances, prosthetic devices, laboratory dishware, etc.) over the hopper sink are subject to splashing, when the above mentioned articles are emptied into the hopper or as the water from the spigot used to clean the above mentioned articles sometimes bounces off the article or the material contained therein. This water, along with other fluids or particles from the articles, can contain various chemicals or pathogens such as coliform, fecal and blood borne pathogens, including hepatitis B, and possibly HIV, or any of many other hazardous substances. The operator may be subject to the staining of clothing and/or the diseases and chemicals associated therewith if exposed to the splashing of water and fluids.

To minimize potential dangers from splashback, operators using these hopper sinks usually wear gloves, protective clothing, masks, caps and the like. However, if an operator is in a hurry, he or she may forget to wear any or all of this protective clothing. Additionally, there are portions of the body usually not covered by such protective clothing, such as the area around the face (eyes, nose, mouth, etc.). Should germs, bacteria, or blood borne pathogens enter any surface on the face, the operator may become infected and/or transport these pathogens to the other areas, thereby exposing others.

SUMMARY OF THE INVENTION

The present invention provides the operator with protection from pathogens and fluids by bringing to the art a device for use in conjunction with a hopper sink which provides the operator with a protected environment, allowing for operations within the hopper sink by elimination of potential splashing, providing further protection for the worker. The device comprises a shield attached to a member which mounts the shield (and ultimately the entire device) to hopper sink, along the rim of the basin. The shield is attached to the basin mounting means by attaching means. These attaching means are designed to bias the shield in a direction away from the basin.

BRIEF DESCRIPTION OF THE DRAWINGS

The present invention will be described with reference to the accompanying drawings, wherein like reference numerals identify corresponding or like components.

In the drawings.

DETAILED DESCRIPTION OF THE DRAWINGS

Figure 1:
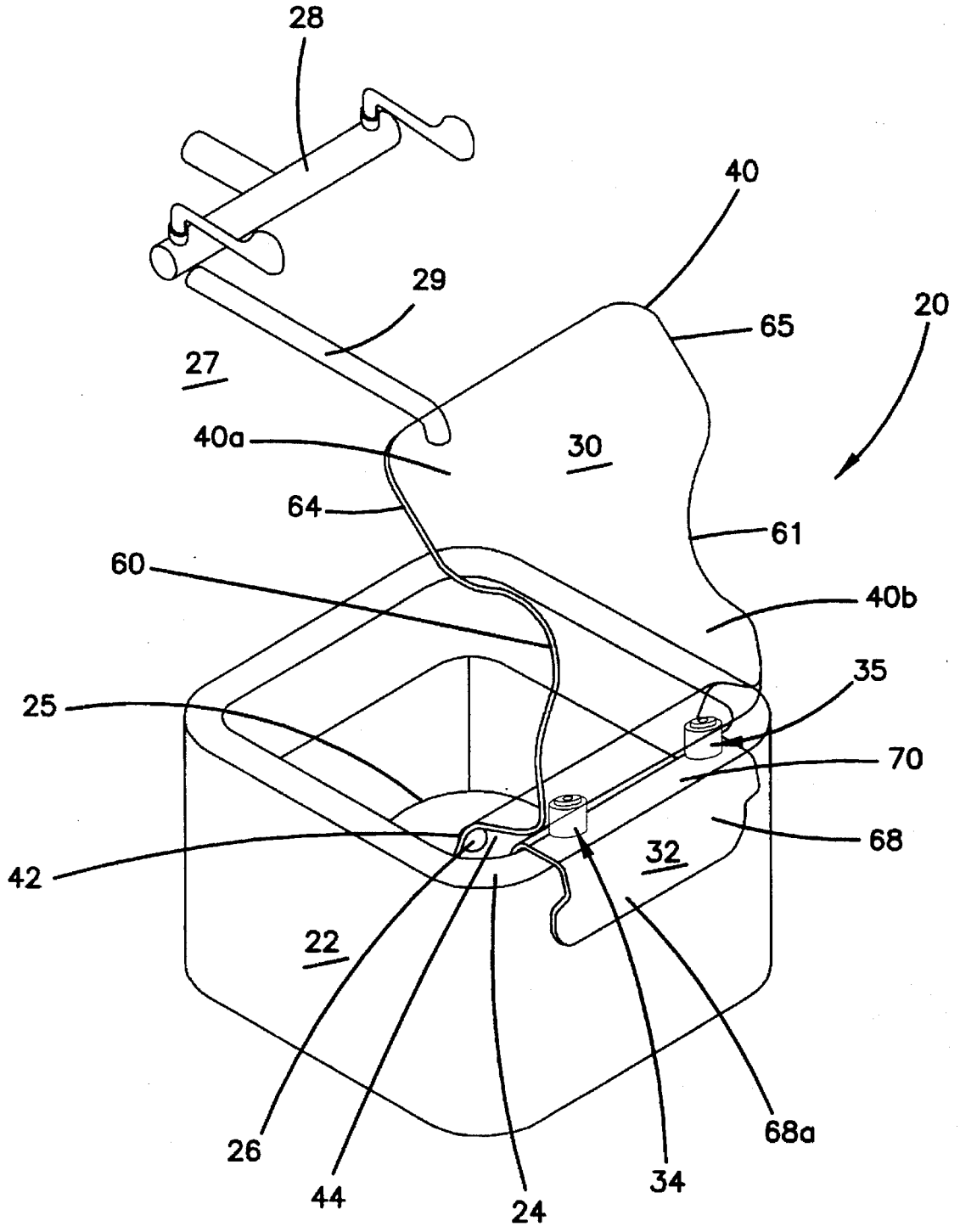
FIG. 1 is a perspective view of the apparatus of the present invention as mounted on a hopper sink.
Figure 2:
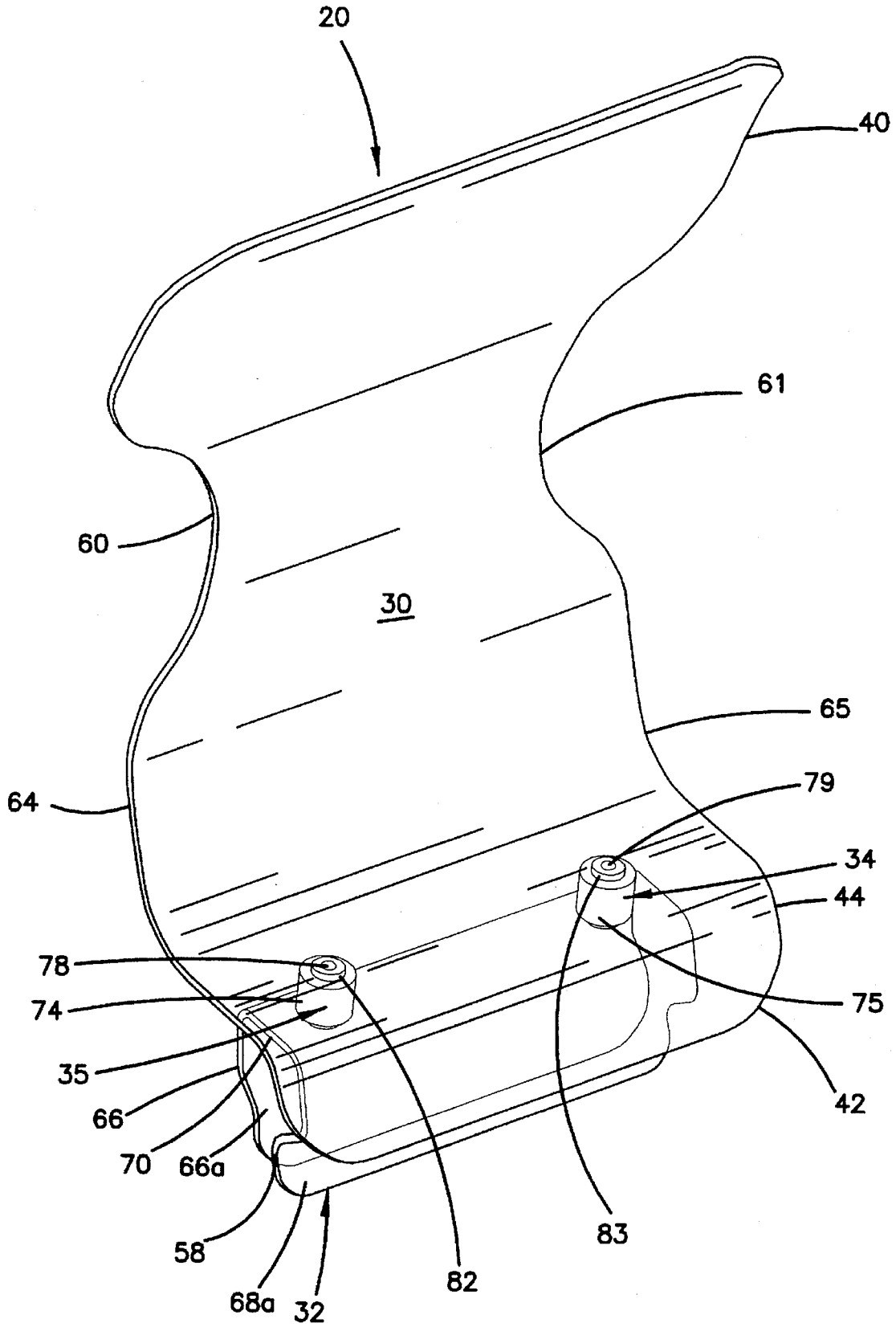
FIG. 2 is a perspective view of the apparatus of the present invention.

Turning now to FIGS. 1 and 2, there is shown the apparatus 20 of the present invention. In FIG. 1, The hopper sink 22 is typically bordered by a rim 24, includes a deep basin 25 with a drain 26, and is mounted against a wall 27 or other stable support structure. Water is supplied to the hopper sink 22 by a conventional faucet 28 and spigot 29.

Referring also to FIG. 2, the apparatus 20 includes a shield 30, attached to a base 32 by mounts 34, 35. The base 32 is designed for connecting to the rim 24 of the hopper sink 22 to securely mount the apparatus 20 to the hopper sink 22.

The shield 30 is preferably transparent and curved in a "C" shape. The shield 30 includes an upper portion 40, extending above the basin 25, a lower portion 42, extending into the basin 25, and an intermediate portion 44, connecting the upper and lower portions 40, 42.

Figure 3:
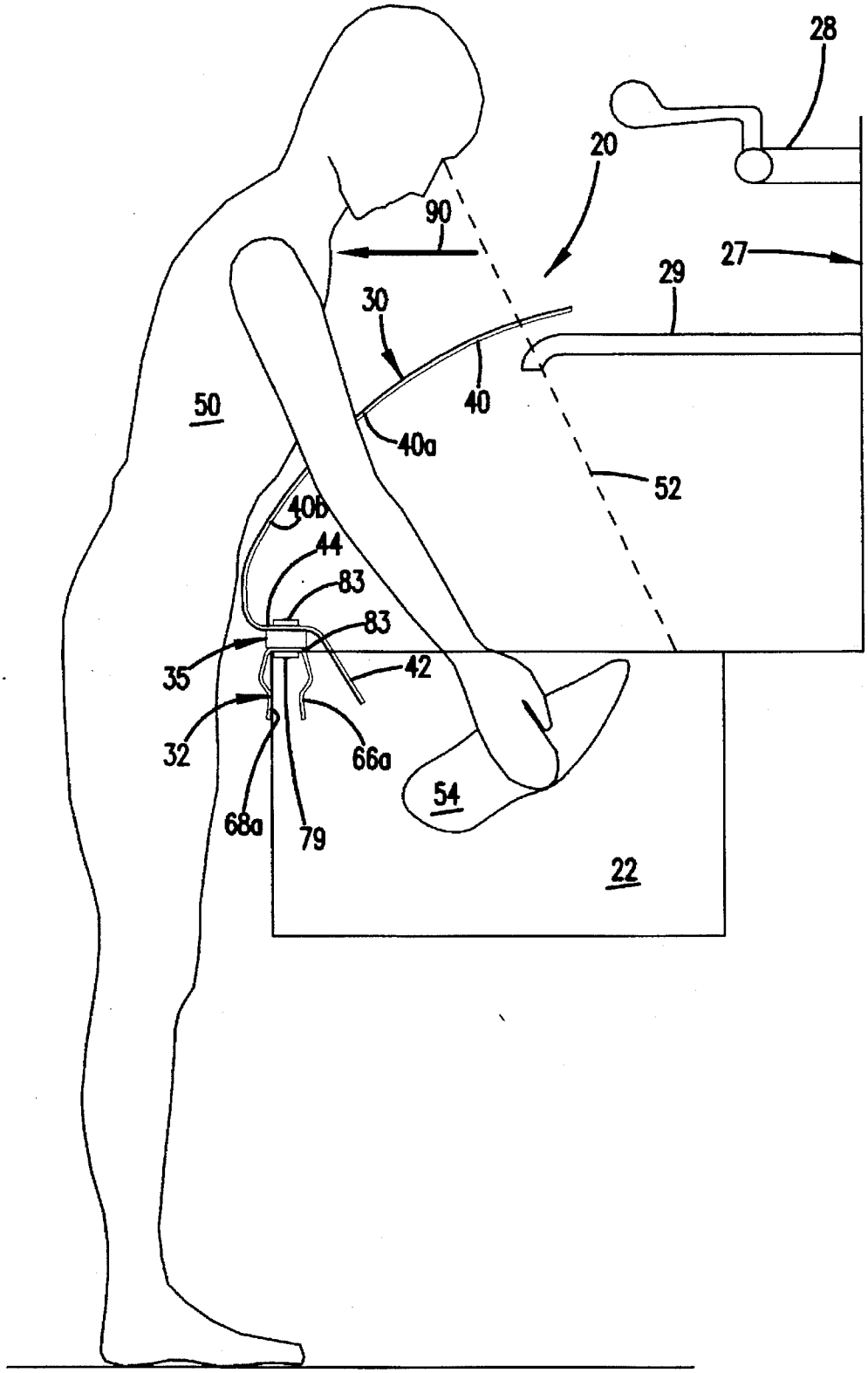
FIG. 3 is a side view of the present invention in operation.

The upper portion 40 is longer than the lower portion 42 and, as shown in FIG. 3, extends upward to a point where the operator 50 continuously possesses a clear sight line, shown by broken line 52, into the basin 25, to perform the requisite emptying, cleaning and sanitizing operations, such as on a bedpan 54. During this operation, the facial and head areas of the operator 50 remain shielded. The upper portion 40 is "hourglass" shaped with recesses 60, 61 at the sides 64, 65 of this upper portion 40, to accommodate the arms of an operator 50. Additionally, the upper portion 40 has a top section 40*a* of a width greater than the bottom section 40*b*, to conform to the shape of the human body. These features allow the operator 50 complete unobstructed access to the basin 25, to perform the instant tasks, while being shielded.

The lower portion 42 of the shield 30 is curved toward and extends into the basin 25. This design allows fluid and particles which have splashed against the shield 30 to fall or drip into the basin 25, in a direction away from the operator 50.

The intermediate portion 44 serves to provide attachment points for the mounts 34, 35 to connect the shield 30 to the base 32. Specifically, connections are made with bolt assemblies 78, 79 of the mounts 34, 35, to the intermediate portion 44 and the base 32. The intermediate portion 44 is oriented such that it is somewhat parallel to the cross member 70 of the base 32. This orientation enables the mounts 34, 35, to firmly attach the shield 30 (at this intermediate portion 44) to the base 32, such that the apparatus 20 remains stable.

The shield 30 is preferably a unitary, one piece, rigid member. Accordingly, the shield 30 moves as a single unit. Specifically, when the upper portion 40 is pressed inward, as would be the case when the operator 50 (shown in FIG. 3) is working within the basin 25, the lower portion 42 of the shield 30 will move with a displacement proportional to the displacement of the upper portion 40. The shield 30 is made of a rigid plastic such as, PETG (Co-Polyester) or polycarbonate. Other similar materials such as acrylics (i.e., IMPLEX®) or plexiglass may also be used. These shield materials are sanitary, as they can be wiped clean, and treated with various disinfectant agents without degrading or retaining germs. The shield 30 is preferably made by techniques such as injection molding, drape or vacuum forming, or the like.

The base 32 is preferably transparent and includes inner and outer side members 66, 68, joined by a cross member 70. The cross member 70 includes openings (not shown) to accommodate the bolt assemblies 78, 79, that connect the shield 30 to the base 32. These side and cross members 66, 68, 70 are arranged in a "U" shape to fit over and around the rim 24 of the basin 25, to firmly support the shield 30. The base 32 preferably includes side members 66, 68 with inwardly curved portions, 66*a*, 68*a*, which, coupled with the resilient material of the base 32, operate as a clamp, to securely mount the apparatus to the basin 25, such that it remains stable during use. The preferred inner side member 66*a*, extends into the basin 25, and is slightly longer than outer side member 68 to further stabilize the apparatus 20. However, the sizes of the side and cross members 66, 68, 70, need only be sufficient to firmly anchor the apparatus 20 over the rim 24 of the basin 25. As a result of this structure, the apparatus 20 is portable, and can be placed on and removed from the hopper sink 22 when desired.

Should a permanent mount be desired, the base 32 may include bores (not shown) on any one or all of the side or cross members 66, 68, 70 to accommodate screws or other equivalent fasteners. The base 32 may also be attached to the basin 25 by adhesives or other attachment mechanisms. Should a permanent mount be desired, the base need not have the inwardly curved portions 66*a*, 68*a*, since the screws, adhesives, or the like, provide stability.

The preferred base 32 is a unitary member, preferably made of a resilient material such as plastic, including PETG (Co-Polyester), by techniques well known in the art, i.e., injection molding, drape or vacuum molding. Metal is also suitable, for like plastic, it can be wiped clean, free of germs, and will not degrade when exposed to common disinfectants.

The mounts 34, 35 include resilient bodies 74, 75, which extend between the intermediate portion of the shield 44 and the cross member 70 of the base 32. The body 74, 75, of each mount 34, 35 is attached to the respective shield and base portions by bolt assemblies 78, 79. Elastomeric washers 82, 83, between the bolt assemblies 78, 79 (FIGS. 2 and 3) and the shield 30 and base 32 eliminate any play in the mounts 34, 35, reduce stress in the lower portion 42 and intermediate portion 44 (in particular in the intermediate portion 44).

The mounts 34, 35 are preferably made of a resilient elastomeric material such as neoprene rubber, natural rubber, or the like. The washers 82, 83 are also made of resilient elastomers including neoprene rubber or natural rubber.

The resilient mounts 34, 35, as a result of attachment to the shield 30 and base 32, function to bias the shield 30, in the presence of a resistive force. Specifically, the upper portion 40 is biased away from the basin 25, when an inward force, such as the operator 50 pressing the shield toward the basin, is applied to the upper portion 40 of the shield 30 (in the direction of the arrow 90 as shown in FIG. 3). These mounts 34, 35 allow for sufficient movement of the shield 30 such that the operator 50 is able to work within the basin 25 with his or her arms unconstrained, without any impedance from these resistive forces. Moreover, when the operator 50 has completed the requisite operation within the basin 25, and moves away from the apparatus 20, the shield 30 returns to its original position (moving in the direction of arrow 90).

Alternate shield attaching embodiments may involve as few as one mount, or a plurality of mounts, depending on the size of the shield. Other shield attaching embodiments could include clips attached to the base, the clips having openings for receiving a single extended protrusion, or protrusions extending from the shield, in a male-female frictional engagement. Still other alternate shield attaching embodiments could include mounts connected to the base, the mounts including throughgoing bores which align with a tube or tubes on the shield. A rod would then extend through the same in the first mount, through the tube (or tubes), and through the bore in the second mount. The rod ends would be capped at the ends of the mounts to maintain the connection.

Finally, alternate embodiments of this apparatus 20 may exclude this base 32 altogether. These alternate embodiments would have mounts 34, 35 directly attached to the rim 24 of the basin 25. The mounts 34, 35 could be either permanently mounted to the hopper sink 22 by mechanical fasteners, such as screws, rivets, adhesives, or the like, or temporarily mounted with suction cups or the like.

Figures 4, 5:
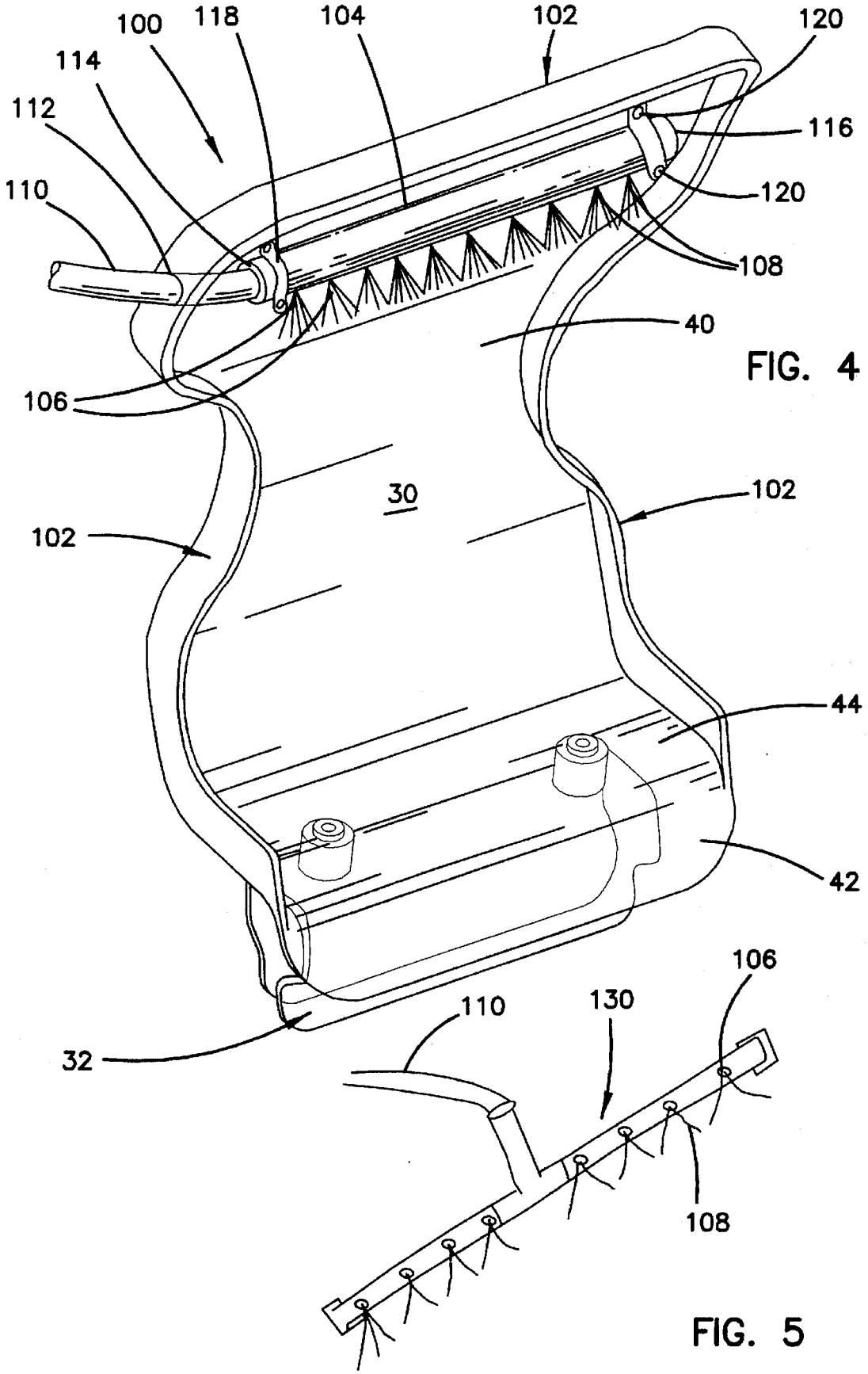
FIG. 4 is a perspective view of a modified apparatus of the present invention.
FIG. 5 is a perspective view of a second sprayer in an inverted position for use with the apparatus of FIG. 4.

FIG. 4 shows a modified apparatus 100 of the present invention. This apparatus 100 is similar to the apparatus 20 disclosed above (in FIGS. 1–3), except the shield 30 includes a peripheral skirt 102, extending from the shield 230 in the direction of the basin 25 (FIGS. 1 and 3). This apparatus 100 includes sprayer 104, having plural openings 106 through which fluid (i.e., water, cleansing or disinfecting fluid, or other liquid) 108 contacts the shield 30. The fluid 108 is supplied to the shield 30 by a line 110.

The peripheral skirt 102 preferably extends continuously along the top and sides of the shield 30 along the upper portion 40 through the intermediate portion 44, to at least the lower portion 42. The peripheral skirt 102 serves to prevent fluid 108 from the sprayer 104 from leaving the shielded basin area, while allowing the fluid 108 to flush the dirty surface of the shield 30. The peripheral skirt 102 may include an opening 112 for accommodating the line 110, but the line 110 may also be draped around the peripheral skirt 102 and connected to the sprayer 104.

The peripheral skirt 102 is preferably made of the same material as the shield 30 and with the shield 30 is preferably a one-piece rigid member. This one piece rigid member may be made by techniques such as injection molding, drape or vacuum forming, or the like. Alternately, the peripheral skirt 102 may be a separate piece or pieces, attached to the shield 30 by conventional fastening techniques such as adhesive bonding, spot welding, mechanical fastening or the like.

The sprayer 104, is formed as a hollow tube, and includes plural openings 106 positioned to place fluid 108 onto the shield 30 with minimal splashing. The line 110, connected to the sprayer 104, can be a hose for supplying water from a faucet or tank (not shown), or a specialized conduit for supplying cleansing or disinfecting fluid or other liquid from a supply source (not shown) and/or water, from a faucet, tank, or other source. When the line 110 supplies cleansing or disinfecting fluid or other liquid, an aspirator (not shown) or a venturi (not shown) can be placed along the specialized conduit to dispense the cleansing or disinfecting fluid or other liquid. The sprayer 104 receives fluid at one end 114 and is capped at the opposite end 116. Clips 118, with bolt assemblies 120, secure the sprayer 104 to the shield 30. Alternate fastening arrangements well known to those skilled in the art are also permissible.

FIG. 5 shows an alternate "T" shaped sprayer 130 for use with the modified apparatus 100. This sprayer 130 is formed of hollow tubes, functions identically to the sprayer 104 disclosed above (FIG. 4), and is designed to be positioned and mounted in a manner similar to that sprayer 104. Use of this "T" shaped sprayer 130 preferably involves placement of an opening in either the shield 30 or the top of the peripheral skirt 102 to accommodate the tube 110. However, the line 110 could be draped around the peripheral skirt 102 if necessary.

While the invention has been described in connection with embodiments, it will be understood that the invention is not limited to these embodiments. The invention is intended to cover all alternatives, modifications and equivalents as may be included within the spirit and scope thereof, as determined by the appended claims.

What is claimed is:

1. An apparatus for placement over a basin to protect an operator from splashing liquid comprising:

a) a curved shield including a first portion extending outside of the basin and a second portion extending inside the basin, and an intermediate portion being between the first and second portions;

b) means for mounting the apparatus on the basin; and c) means for attaching the shield to the mounting means, the attaching means connecting to the shield at the intermediate portion, the attaching means providing a biasing force to the shield in a direction away from the basin when a force is applied to the shield toward the basin.

2. The apparatus of claim 1, wherein the shield includes a periphery and a skirt extending substantially continuously along at least a portion of the periphery.

3. The apparatus of claim 2, wherein the skirt is directed toward the basin.

4. The apparatus of claim 1, wherein the shield is a rigid unitary member.

5. The apparatus of claim 1, wherein the first portion of the shield includes openings for accommodating the arms of the operator.

6. The apparatus of claim 1 wherein the attaching means includes at least one mount.

7. The apparatus of claim 1, wherein the first portion of the shield is hourglass shaped, the hourglass shape dividing the shield into a first section and a second section, the first section having a greater width than the second section for accommodating the human body such that the operator can work in the basin with his or her arms minimally constrained.

8. An apparatus for placement over a basin to protect an operator from splashing liquid comprising:

a) a shield;

b) means for mounting the apparatus on the basin;

c) means for attaching the shield to the mounting means; and d) a sprayer mounted to the shield for introducing fluid to the shield for flushing the shield.

9. The apparatus of claim 8, additionally comprising means for substantially confining the introduced fluid to the shield.

10. The apparatus of claim 9, wherein the shield is curved and includes a first portion extending outside of the basin and a second portion extending inside the basin, and an intermediate portion between the first and second portions, the means for substantially confining the introduced fluid to the shield including a skirt extending substantially continuously along at least the first portion and the intermediate portions of the shield in a direction toward the basin.

11. The apparatus of claim 10, wherein the first portion of the shield is hourglass shaped, the hourglass shape defined in part by openings for accommodating the arms of the operator, the openings dividing the shield into a first section and a second section, the first section having a greater width than the second section for accommodating the human body such that the operator can work in the basin with his or her arms minimally constrained.

12. The apparatus of claim 10, wherein the attaching means connects to the shield at the intermediate portion.

13. The apparatus of claim 12 wherein the pivotally attaching means include at least one mount.

14. The apparatus of claim 8 wherein the attaching means provide a biasing force to the shield in a direction away from the basin, when a force is applied to the shield toward the basin.

* * * * *